United States Patent [19]

Brazell et al.

[11] 4,281,765

[45] Aug. 4, 1981

[54] ARTICLE-DETECT SIGNAL SEPARATING NETWORK

[75] Inventors: Charles R. Brazell; Joseph A. Villanueva, both of Houston, Tex.

[73] Assignee: Geosource Inc., Houston, Tex.

[21] Appl. No.: 65,371

[22] Filed: Aug. 9, 1979

Related U.S. Application Data

[62] Division of Ser. No. 43,694, May 30, 1979.

[51] Int. Cl.[3] ..... B07C 5/342

[52] U.S. Cl. ..... 209/576; 209/564; 250/223 R; 235/92 PK

[58] Field of Search ..... 209/552, 576, 577, 580, 209/581, 582, 564, 565, 586; 356/402, 445, 448; 250/223 R; 235/92 R, 92 PK

[56] References Cited

U.S. PATENT DOCUMENTS 3,977,526 8/1976 Gordon et al. ..... 209/565

4,120,403 10/1978 Stephanos ..... 209/586 X 4,139,766 2/1979 Conway ..... 235/92 PK

*Primary Examiner*—Joseph J. Rolla

*Attorney, Agent, or Firm*—Arnold, White & Durkee

[57] ABSTRACT

A network for separating an article-detect signal into a number of parts corresponding to the number of articles randomly disposed in next-abutting relationship is characterized by a circuit arrangement adapted to sample and hold a predetermined percentage of the peak magnitude of a characteristic signal representative of each article, a comparator for comparing the instantaneous value of the characteristic signal with the predetermined peak and for generating an enabling signal when the instantaneous characteristic signal falls below the predetermined percentage, and a timer responsive to the enabling signal to interrupt the article-detect signal for a predetermined time interval after a predetermined time delay.

15 Claims, 9 Drawing Figures

SCAN LINE S
A1
A2
A3

-V
CHARACTER IST SIGNAL INPUT ON LINE 26
R
t'

SIGNAL ON LINE 28A
ta
tc
t'

LINE 48
LINE 61
VOLTAGE PEAK1
P% OF PEAK1
SIGNAL ON LINE 48
SIGNAL ON LINE 61
VOLTAGE PEAK 2
P% OF PEAK2
SIGNAL ON LINE 48
SIGNAL ON LINE 61
tg1
TDELAY
tg2
TDELAY

OUTPUT OF 64
tb
td
tf

OUTPUT OF 66
tg
td
te
tf

ART. DET. LINE 27
ta
tb
tc
tc
td
te
tf
tg2
28A
67
31
27

ARTICLE-DETECT SIGNAL SEPARATING NETWORK

CROSS-REFERENCE TO RELATED APPLICATION

This application is a division of an application of Michael C. Hoover, et al., Ser. No. 043,694, filed May 30, 1979, assigned to the assignee of the instant invention.

BACKGROUND OF THE INVENTION

1. Field of the Invention

This invention relates to an article-detect signal generating network for a sorting apparatus, and in particular, to a network adapted to separate an article-detect signal generated by two randomly disposed, next-abutting articles so as to denote the presence of two separate articles.

2. Description of the Prior Art

A sorting apparatus adapted to classify articles disposed randomly within a viewing zone typically includes a viewer for viewing the zone in which the articles are disposed. Such sorting apparatus is responsive to the light reflected from the articles within the viewing zone to generate characteristic signals representative of a predetermined physical characteristic of each article. For example, it is known that all organic matter reflects light in the infrared range. Thus, an electrical characteristic signal representative of reflected infrared light would contain information regarding the presence and location of an article within the viewing zone.

In apparatus adapted to classify an array of randomly disposed articles, signals indicative of the presence and location of articles within the viewing zone assume a critical importance. For unlike the situation extant in apparatus adapted to sort highly predictable, channelized arrays of articles, there is no guarantee in a random sorting apparatus that an article will occupy a given position within the viewing zone. It is now typical practice to generate "article-detect" signals in such random sorting apparatus by a comparison of the characteristic signal representative of light reflected from articles with some predetermined reference level. So long as the characteristic signal exceeds the reference level (selected so as to avoid extraneous reflections from triggering the classification circuitry), an "article-detect" signal is generated.

Complications arise, however, when consideration is given to the case wherein two (or more) articles happen to randomly abut one against the other in the viewing zone. In this instance, it is necessary to provide some mechanism whereby the classification circuitry is made aware of the presence of the two (or more) distinct articles. It is an object of this invention to provide circuit arrangement adapted to separate the article-detect signals produced by two (or more) separate but next-abutting articles to indicate to the classification circuitry the presence of two (or more) different articles.

SUMMARY OF THE INVENTION

This invention relates to a network adapted to interrupt an article-detect signal to indicate the presence of two (or more) discrete articles disposed in a next-abutting relationship within a viewing zone. The article-detect signal may be generated by a comparator arrangement adapted to generate such a signal so long as a characteristic signal from each article exceeds a threshold reference level. Due to the next-abutment of articles, however, there arise instances when the article-detect signal remains asserted, ostensibly indicating the presence of a single article, when, in fact, there are two (or more) discrete articles in next-abutting relationship.

The invention includes a network for sampling and holding a predetermined percentage of the peak magnitude of the characteristic signal (or of a signal functionally related thereto) for each of the abutting articles, a comparator for comparing the instantaneous characteristic signal (or a signal functionally related thereto) for each article with the percentage of the peak magnitude thereof and for generating an enabling signal when the instantaneous signal falls therebelow, and a timing arrangement responsive to the enabling signal for interrupting the article-detect signal for a predetermined time interval, the interruption in the article-detect signal occurring within a predetermined delay time after the instantaneous signal falls below the predetermined percentage of the peak.

The sample and hold network, in the preferred embodiment, includes a capacitor adapted to charge to a voltage level functionally related to the maximum, or peak, amplitude of the characteristic signal, means, such as a diode, for maintaining the peak voltage on the capacitor, and means, such as a variable resistor or a voltage divider network, adapted to apply a predetermined percentage of the peak voltage stored on the capacitor to the comparator. The percentage is selectably adjustable.

The timing network includes first and second monostable multivibrators, or one-shots, connected in series, the first one-shot being responsive to the enabling signal to generate a pulse of a duration substantially equal to the delay time between the time the instantaneous signal falls below the peak and the time the instantaneous signal moves toward another peak, the second one-shot being triggered at the end of the pulse from the first one-shot to generate a pulse of a predetermined duration during the presence of which the article-detect signal is interrupted.

BRIEF DESCRIPTION OF THE DRAWINGS

The invention will be more fully understood from the following detailed description thereof, taken in connection with the accompanying drawings, which form a part of this application and in which.

DESCRIPTION OF THE PREFERRED EMBODIMENT

Figure 1:
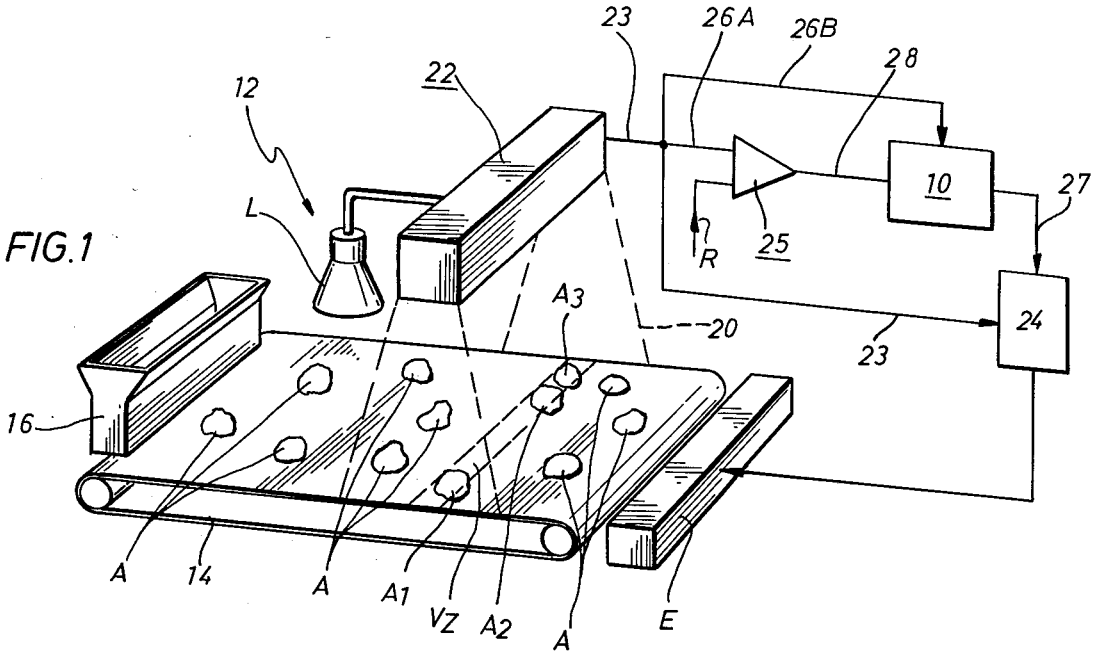
FIG. 1 is a highly stylized pictorial and block diagram representation of the environment in which a network in accordance with the instant invention finds utility.

Throughout the following description, similar reference numerals refer to similar elements in all Figures of the drawings.

In FIG. 1, shown is a highly stylized pictorial and block diagram illustration of an article-detect signal separating network 10 shown in the environment of a sorting apparatus generally indicated by reference character 12. In general, the sorting apparatus 12 includes an article conveyor 14 onto which articles A to be sorted, such as tomatoes or other comestibles for example, are deposited from a source thereof, such as an inlet hopper 16 or inlet conveyor. The articles A to be sorted are randomly disposed across the transverse width of the article conveyor 14, and are conducted thereby through a viewed area generally indicated at reference character 20 where articles A occupying a viewing zone VZ defined within the viewed area 20 are scanned or otherwise viewed by a viewer arrangement 22. Suitable illumination sources, as at L, are provided to illuminate the viewed area 20.

The viewer 22 includes means for generating an electrical characteristic signal, carried by a line 23, representative of light reflected from articles A randomly disposed within the viewing zone VZ. For example, each article A may be of a nature such that it exhibits a certain reflectivity of certain light wavelengths, such as infrared light, which is gathered by the viewer 22 and used therein to generate a characteristic signal representative of light reflected from the article A.

The sorting apparatus 12 further includes, in the general case, a classifier 24 to which the characteristic signals on the line 23 are applied and in which a decision as to the acceptability of each article A may be generated. Of course, articles classified as unacceptable are suitably eliminated from the article stream, as by ejectors E.

It is appreciated, of course, that the characteristic signal generated by the viewer arrangement 22 contains information regarding the presence and location of an article within the viewing zone VZ. As such, it is convenient to utilize this information content by generating "article-detect" signals which may be used to enable the classifier 24. The generation of article-detect signals is typically accomplished by the provision of a comparator 25 which receives the characteristic signal on a line 26A. The characteristic signal is also applied to the network 10 on a line 26B. The comparator 25 generates an article-detect signal which is applied by a line 28 to the network 10 for use therein and over a line 27 (from the network 10) to the classifier 24 for use therein. The article-detect signal on the line 27 is asserted so long as the characteristic signal of the article exceeds a predetermined reference or unless interrupted by the action of the article-detect signal separating network 10.

It is possible, owing to the random disposition of articles A on the conveyor 14, that certain articles within the viewing zone VZ (such as the articles $A_2$ and $A_3$) may be disposed in next-abutment one to the other such that light reflected from both articles does not fall below the reference level. Accordingly, the classifier 24 is not made aware of the presence of two discrete articles within the viewing zone VZ. It is for the purpose of separating the article-detect signal when two (or more) articles are next-abutting one with the other that the network 10 in accordance with the instant invention finds utility.

It should be noted that although the invention is most useful in connection with the roll sorting apparatus disclosed and claimed in the co-pending application of Michael C. Hoover, et al., Ser. No. 043,694, filed May 30, 1979, assigned to the assignee of the instant invention, the article-separating network 10 may be used with any apparatus wherein a characteristic or article-detect signal may be separated to indicate the presence of two (or more) discrete, though next-abutting, randomly disposed articles. In the roll sorting apparatus disclosed and claimed in the referenced co-pending application, the viewer 22 includes an arrangement (such as a vidicon tube) for generating an electrical image of the viewed area 20 and the viewing zone VZ therein. The characteristic signals generated by the scan of an electron beam across the electrical image plane are used to generate acceptability signals for each article within the viewing zone.

Figure 3:
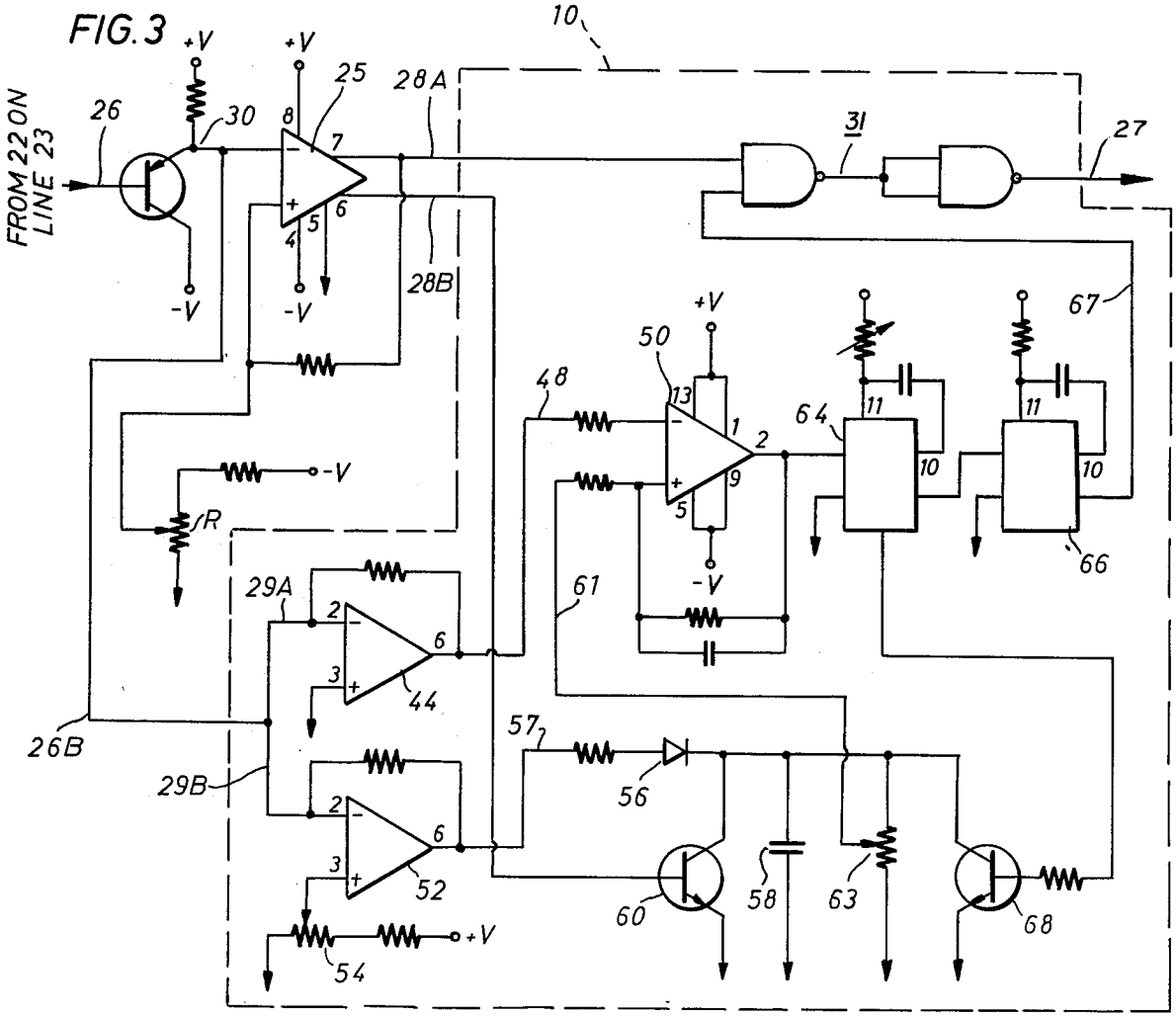
FIG. 3 is detailed schematic diagram of an article-detect signal separating network in accordance with the invention.

With reference now to FIGS. 2 and 3, the circuit configuration and operation of the article-detect signal separating network 10 in accordance with the instant invention may be best understood.

The characteristic signal present at the output of the viewer 22 (FIG. 1) is applied over lines 23 and 26 to an isolation amplifier 30 comprising a PNP transistor and then on the line 26A to the article-detect signal generator 25. The article-detect signal generator includes the comparator 25 having its inverting input applied with the amplified characteristic signal. The non-inverting input of the comparator 25 has a reference voltage level derived from a potentiometer R applied thereto. When the characteristic signal exceeds the reference, an output from the amplifier 25 (pin 7) is generated. The output from the comparator 25, on the line 28A, is gated through an AND gate 31 (which may be part of the network 10) to the classifier 24 on the line 27 and provides an article-detect signal to the classifier 24 to indicate that an article is present within the viewing zone.

Figures 2A, 2B, 2C, 2D, 2E, 2F, 2G:
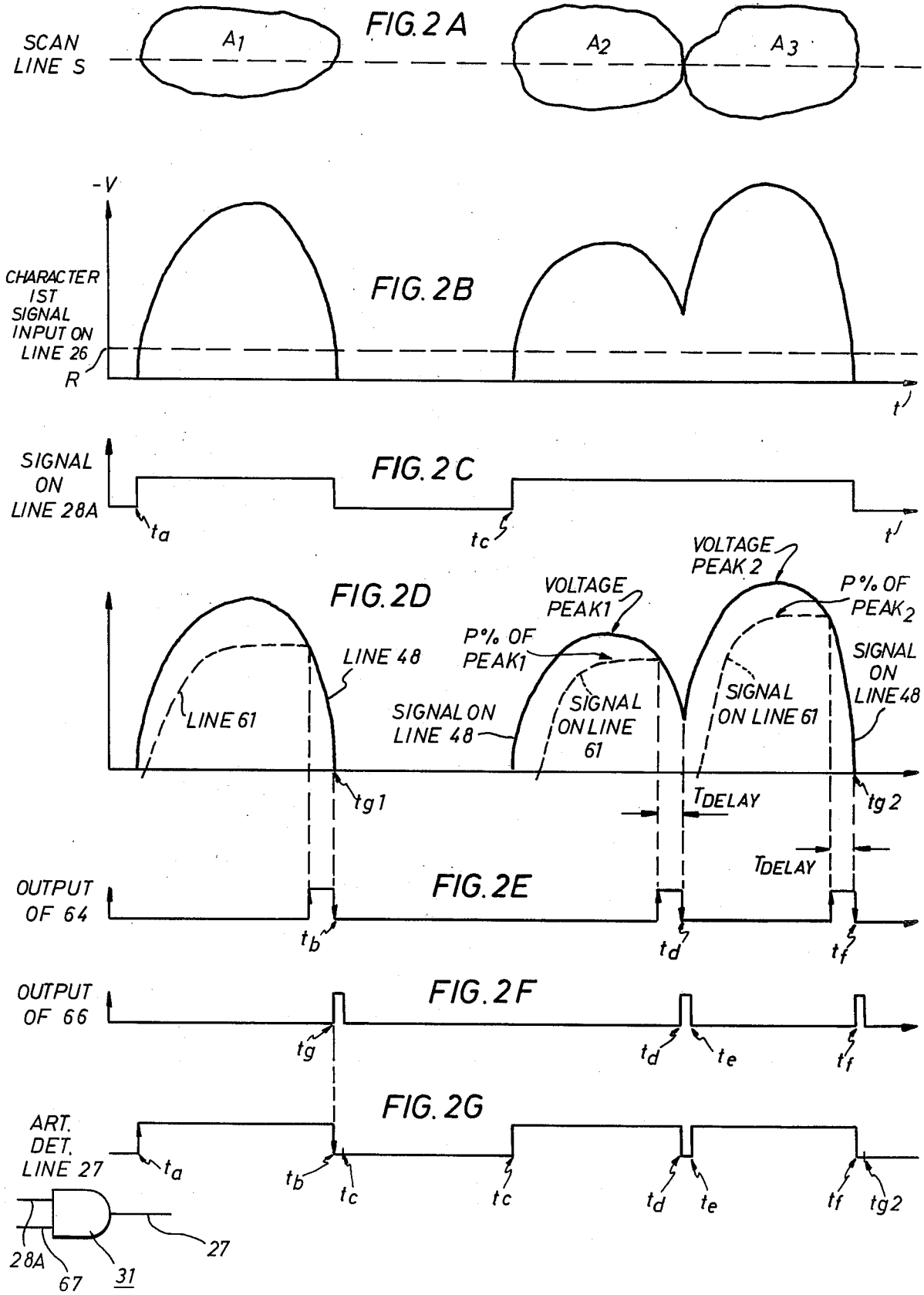
FIGS. 2A–2G are a highly stylized pictorial representation and timing diagrams illustrating the operation of the circuit shown in FIG. 3.

As noted above, it may sometimes occur that due to the random disposition of articles within the viewing zone that two (or more) articles will be in abutting contact next to each other. This situation is illustrated in FIG. 2A (with only two articles, $A_2$ and $A_3$, in next-abutment). Some precautions are necessary to insure that the presence of two distinct articles is indicated to the classifier 24. To this end the article-detect signal separating network 10 in accordance with the instant invention is provided.

The separating arrangement 10 includes a unity gain buffer amplifier 44 provided at its inverting input with the characteristic signal by the lines 26B and 29A (FIG. 3). The output of the amplifier 44 is carried by a line 48 to the inverting input of a comparator 50.

A peak detector amplifier 52 derives its inverting input on a line 29B (FIG. 3) from the characteristic signal on the line 26B. The non-inverting input is provided with a reference voltage derived from the wiper of a potentiometer 54 connected between a positive potential and ground.

The output of the peak detector amplifier 52 is applied through a diode 56 connected in a line 57. A capacitor 58 is connected between the line 57 at the cathode of the diode 56 and ground. The capacitor is shunted by a switch 60, such as a transistor of the NPN type, the base of which is connected by a line 28B to the complementary output terminal of the comparator 25 (pin 6). Of course, any suitable switch, including an FET, may be used as the switch 60. A line 61 is connected to the wiper of a potentiometer 63 which is connected in parallel across the capacitor 58. The line 61 is connected to the non-inverting input of the comparator 50.

The output of the comparator 50 triggers a monostable multivibrator, or one-shot 64, the duration of which is adjusted for a purpose set forth herein. At the termination of the period of the one-shot 64, a second one-shot 66, having a predetermined duration equal to 250 nanoseconds, is triggered. The output of the one-shot 66 is applied to the AND gate 31 over a line 67. The one-shot 64 is arranged to render conductive a switch 68, such as an NPN transistor or other suitable device such as an FET, connected in parallel across the capacitor 58 and ground. Suitable for use as the one-shots 64 and 66 are devices manufactured by Texas Instruments and sold under model number 74121.

The operation of the article-detect signal generator and the separating network may be understood with reference to the timing diagram of FIG. 2B and the schematic diagram shown in FIG. 3. During the following discussion, it is assumed that the viewer 22 is scanning across a given scan line-S in accordance with the description set forth in the referenced co-pending application and that articles $A_1$, $A_2$ and $A_3$ are present on that line-S, with the articles $A_2$ and $A_3$ being in next-abutting relationship as shown in FIG. 2A. Of course, the principles set forth herein are equally applicable to any apparatus wherein an article-detected signal is generated.

As the viewer sweeps across the scan line-S the magnitude of the characteristic signal presented to the inverting input of the amplifier 25 corresponds to the waveform shown in FIG. 2B.

The threshold voltage applied from the potentiometer R to the non-inverting input of the comparator 25 is indicated by the dotted line extending substantially parallel to the axis in FIG. 2B. When the waveform representative of the infrared signal corresponding to the article $A_1$ exceeds the threshold imposed by the potentiometer R, the comparator 25 generates an output on the line 28A (FIG. 2C) which is applied to the AND gate 31. As long as the waveform representative of the article $A_1$ exceeds the threshold R, an output signal on the line 28A is presented to the gate 31 and a signal ARTICLE-DETECT representative of the presence of the article $A_1$ is transmitted on the line 27 to the classifier 24. When the viewer's scan falls off the article $A_1$, the characteristic signal representative thereof correspondingly drops below the threshold R and the signal representation on the line 28A correspondingly falls (FIG. 2C). (In the circuit configuration shown in FIG. 3, it is appreciated that the waveform of the characteristic signal exhibits a negative peak.)

Continued movement of the viewer scan beam across the scan-line S will generate a second negative-to-positive transition of the signal on the line 28A when the viewer encounters the left hand edge of the article $A_2$. It is noted that the characteristic signal waveform will have an intensity greater than the threshold R until the scan falls off the right edge of the article $A_3$. However, it is imperative that some mechanism be provided whereby the classifier 24 is made aware of the presence of the two articles $A_2$ and $A_3$ abutted next-adjacent each other.

The characteristic signal is applied over the lines 26B and 29A and 29B to the inverting unity gain buffer amplifiers 44 and 52. This signal (shown in the solid line in FIG. 2D) is applied on the line 48 to the inverting input of the comparator 50. The waveform generated on the line 48 (and on the line 57) is the same shape as the inverted waveform at the input of the amplifier 25 (FIG. 2B).

The output of the amplifier 52 on the line 57 is substantially in-phase with but less positive than the signal from the output of the amplifier 44. This signal is applied through a peak detector network which includes the diode 56, the capacitor 58 and the switch 60 (the NPN transistor). A percentage of the charge on the capacitor 58 is applied from the wiper arm of the potentiometer 63 on the line 61 to the non-inverting input of the comparator 50. The signal on the line 61 (shown in dotted lines in FIG. 2D) follows the waveform of the signal on the line 48 as that signal rises to a peak. The percentage may be selected anywhere in the range $0\% \leq p\% \leq 100\%$. The voltage level to which the capacitor 58 will charge is dependent upon the offset imposed on the amplifier 52 by the potentiometer 54 and the characteristic signal. The voltage on the line 61 thus tracks the rising signal on the line 48 and provides reference (equal to the percentage p % of the peak thereof) to the comparator 50.

When two articles, such as $A_2$ and $A_3$, are next-abutting, the signal on the line 61 is generated as follows. The complementary signal from the comparator 25 is applied on the line 28B to turn off the transistor switch 60. The capacitor 58 charges through the diode 56 so that the charge on the capacitor 58 is representative of the peak voltage of the signal from the amplifier 52. When the signal of the line 48 (related to the characteristic signal) passes its peak, the diode 56 ceases to conduct and the capacitor 58 is no longer charged. Although some decay of the voltage on the capacitor 58 occurs, it may be readily understood that a voltage substantially equal to the positive peak of the signal from the amplifier 52 (the predetermined percentage of the characteristic signal peak) is maintained on the line 61 to the non-inverting input of the comparator 50.

As the representation of the characteristic signal on the line 48 falls below the threshold established on the line 61 by the capacitor 58 and the potentiometer 63, the comparator 50 generates an output pulse to the one-shot 64 (FIG. 2E). The one-shot 64 times out a predetermined duration after which the second one-shot 66 is actuated (FIG. 2F). The duration of the one-shot 64 is selected such that the one-shot 64 provides a delay time TDELAY substantially equal to the time necessary for the waveform representative of the article $A_3$ to begin to move toward its peak. This period is, however, adjustable. The output signal from the one-shot 66 changes the state of the digital ARTICLE DETECT output signal (FIG. 2G) from the gate 31 and imposes a separation in that article-detect signal for a period of greater than or equal to 250 nanoseconds. Effectively, then, the ARTICLE-DETECT signal applied to the classifier 24 is forced to define a separation representative of the abutment between articles $A_2$ and $A_3$. When the first one-shot 64 is asserted, the switch 68 is rendered conductive thus draining the charge on the capacitor 58.

As the viewer scan then begins to climb a positive slope in response to the movement over the article $A_3$, the capacitor 58 again charges to a peak level coinciding with the peak of the signal from the amplifier 52. The peak signal is again held by the capacitor 58 and the percentage p thereof is applied to the non-inverting input of the comparator 50 on the line 61. As the characteristic signal waveform of the article $A_3$ passes its peak, the diode 56 prevents further charging of the capacitor 58 and maintains the charge on the capacitor. When the instantaneous signal waveform on the line 48 crosses the peak level imposed by the capacitor 58, the one-shots 64 and 66 are again fired. However, it is noted that in this instance the characteristic signal also falls below the threshold imposed by the potentiometer R (indicating the right hand edge of the article $A_3$). Thus, the output signal ARTICLE-DETECT from the gate 31 applied to the classifier 24 on the line 27 goes to zero in any event.

In view of the foregoing it may be appreciated that in accordance with this invention a network is provided whereby the circuitry of the classifier is made aware of the presence of two (or more) distinct (although abutting) articles by the comparison of the instantaneous characteristic signal intensity with a predetermined signal intensity determined by a predetermined percentage of the peak amplitude of the characteristic signal.

Having set forth the preferred embodiment of the invention, those skilled in the art may effect numerous modifications thereto, which are to be construed as falling within the scope of this invention, as defined in the appended claims.

What is claimed is:

1. In a sorting apparatus having:

(a) means for generating an electrical characteristic signal representative of light reflected from articles randomly disposed across a viewing zone; and (b) a comparator for comparing the characteristic signal with a predetermined reference level and for generating an article-detect signal representative of the presence of an article within the viewing zone so long as the magnitude of the characteristic signal exceeds the magnitude of the reference level;

the improvement comprising:

means for separating article-detect signals when two articles are next-abutting one with the other such that a comparison of the magnitude of each characteristic signal of each article exceeds the magnitude of the reference level, said separating means comprising:

a network for sampling and holding a predetermined percentage of the peak magnitude of the characteristic signal for each of the abutting articles;

a comparator for comparing the magnitude of the instantaneous characteristic signal for each article with the predetermined percentage of the peak magnitude thereof and for generating an enabling signal when the magnitude of the instantaneous signal falls below the predetermined percentage of the peak magnitude; and, a timing arrangement responsive to the enabling signal for interrupting the article-detect signal for a predetermined time interval after a predetermined time delay.

2. The sorting apparatus of claim 1 wherein the predetermined time delay is measured from the time that the magnitude of the instantaneous signal falls below the predetermined percentage of the peak magnitude.

3. The sorting apparatus of claim 1 wherein the sample and hold network comprises:

a capacitor adapted to charge to a voltage level functionally related to the peak magnitude of the characteristic signal;

a diode adapted to maintain the peak voltage level on the capacitor; and means for applying a predetermined percentage of the peak voltage stored on the capacitor to the comparator.

4. The sorting apparatus of claim 3 wherein the means for applying the predetermined percentage of the peak voltage stored on the capacitor comprises a variable resistor connected in parallel across the capacitor, the variable resistor including a wiper arm connected to the comparator.

5. The sorting apparatus of claim 3 wherein the predetermined time delay is measured from the time that the magnitude of the instantaneous signal falls below the predetermined percentage of the peak magnitude.

6. The sorting apparatus of claim 3 wherein the predetermined percentage p of the peak voltage stored on the capacitor applied to the comparator lies within the range defined by the relationship $0\% \leq p\% \leq 100\%$.

7. The sorting apparatus of claim 3 wherein the timing arrangement includes a first and a second monostable multivibrator device, the first device being responsive to the enabling signal to generate a pulse of a duration substantially equal to the predetermined time delay, the second device being triggered at the end of the pulse generated by the first device, the second device being adapted to generate a pulse of a predetermined duration during the presence of which the article-detect signal is interrupted.

8. The sorting apparatus of claim 7 wherein the sample and hold network further comprises a switch responsive to the termination of the pulse from the first device to discharge the capacitor.

9. The sorting apparatus of claim 7 wherein the means for applying the predetermined percentage of the peak voltage stored on the capacitor comprises a variable resistor connected in parallel across the capacitor, the variable resistor including a wiper arm connected to the comparator.

10. The sorting apparatus of claim 7 wherein the predetermined time delay is measured from the time that the magnitude of the instantaneous signal falls below the predetermined percentage of the peak magnitude.

11. The sorting apparatus of claim 1 wherein the timing arrangement includes a first and a second monostable multivibrator device, the first device being responsive to the enabling signal to generate a pulse of a duration substantially equal to the predetermined time delay, the second device being triggered at the end of the pulse generated by the first device, the second device being adapted to generate a pulse of a predetermined duration during the presence of which the article-detect signal is interrupted.

12. The sorting apparatus of claim 11 wherein the means for applying the predetermined percentage of the peak voltage stored on the capacitor comprises a variable resistor connected in parallel across the capacitor, the variable resistor including a wiper arm connected to the comparator.

13. The sorting apparatus of claim 11 wherein the predetermined time delay is measured from the time that the magnitude of the instantaneous signal falls below the predetermined percentage of the peak magnitude.

14. The sorting apparatus of claim 11 wherein the sample and hold network further comprises a switch responsive to the termination of the pulse from the first device to discharge the capacitor.

15. The sorting apparatus of claim 14 wherein the predetermined time delay is measured from the time that the magnitude of the instantaneous signal falls below the predetermined percentage of the peak magnitude.

* * * * *